US006808064B1

(12) United States Patent
Fanning

(10) Patent No.: US 6,808,064 B1
(45) Date of Patent: Oct. 26, 2004

(54) HANGER ACCESSORY SLEEVE

(76) Inventor: Tammy Fanning, 13908 Cherry Dr., Plato, MO (US) 65552-8746

( * ) Notice: Subject to any disclaimer, the term of this patent is extended or adjusted under 35 U.S.C. 154(b) by 169 days.

(21) Appl. No.: 10/291,256

(22) Filed: Nov. 12, 2002

(51) Int. Cl.[7] ..... B65D 85/10
(52) U.S. Cl. ..... 206/286; 206/6.1
(58) Field of Search ..... 383/22, 23, 37, 383/38, 39; 206/286, 6.1; 211/85.5; 223/98

(56) References Cited

U.S. PATENT DOCUMENTS

| | | | | | |
|---|---|---|---|---|---|
| 1,564,930 | A | * | 12/1925 | Boyes | 383/23 |
| 2,297,860 | A | * | 10/1942 | Aranow | 223/98 |
| 2,679,877 | A | * | 6/1954 | Leggett | 383/39 |
| 2,710,638 | A | * | 6/1955 | Ford | 383/23 |
| 3,074,452 | A | * | 1/1963 | Bridges | 383/23 |
| 3,834,497 | A | * | 9/1974 | Furst | 190/109 |
| 3,967,666 | A | * | 7/1976 | Farrar | 383/7 |
| 4,026,447 | A | | 5/1977 | Wnek | |
| D308,299 | S | | 6/1990 | Houghtaling | |
| 4,966,287 | A | * | 10/1990 | Snyder | 211/85.2 |
| D321,789 | S | | 11/1991 | Martorella | |
| D321,790 | S | | 11/1991 | Martorella | |
| D327,582 | S | | 7/1992 | Mathews | |
| 5,427,230 | A | | 6/1995 | Mattox | |
| D367,985 | S | | 3/1996 | Hale | |
| 5,509,588 | A | * | 4/1996 | Kimball | 223/98 |
| 6,196,396 | B1 | * | 3/2001 | Bennett | 211/85.3 |
| 6,328,469 | B1 | | 12/2001 | Banco | |

* cited by examiner

*Primary Examiner*—David T. Fidei
(74) *Attorney, Agent, or Firm*—Randal D. Homburg

(57) ABSTRACT

This invention is a clothing accessory sleeve for holding various travel clothing items and accessories adapted to be fitted securely upon a clothes hanger underneath clothing items hung on the clothes hanger, concealing the sleeve beneath the clothing. The sleeve has a multiplicity of closeable pockets to contain accessories and a plurality of horizontal slots to engage scarfs, neckwear, belts and sashes with at least one locking pocket for securing valuable items of jewelry, cash or, in the case of military or police uniforms, insignias and topical pins of rank or valor. An additional lower tubular pocket is also provided for the horizontal placement of longer items oriented in a horizontal carrying position.

6 Claims, 2 Drawing Sheets

HANGER ACCESSORY SLEEVE

CROSS REFERENCE TO RELATED APPLICATIONS

None

BACKGROUND OF THE INVENTION

1. Field of Invention

This invention is a clothing accessory sleeve for holding various travel clothing items and accessories adapted to be fitted securely upon a clothes hanger underneath clothing items hung on the clothes hanger, concealing the sleeve beneath the clothing. The sleeve has a multiplicity of closeable pockets to contain accessories and a plurality of horizontal slots to engage scarfs, neckwear, belts and sashes with at least one locking pocket for securing valuable items of jewelry, cash or, in the case of military or police uniforms, insignias and topical pins of rank or valor. An additional lower tubular pocket is also provided for the horizontal placement of longer items oriented in a horizontal carrying position.

2. Description of Prior Art

The following United States patents were discovered and are disclosed within this application for utility patent. All relate to hanger attaching devices.

In U.S. Pat. No. D 308,299 a decorative hanger cover is shown. A countour hanger cover is shown in U.S. Pat. No. 4,026,447 is shown having a rigid arcuate skirt over the wire hanger. A hanger cover is shown in U.S. Pat. No. D 327 582 to Mathews. A large storage container is disclosed in U.S. Pat. No. 6,328,469 to Banco.

Four accessory organizers are shown in U.S. Pat. Nos. D 321,790, D 321,789 to Martorella and D 367,985 to Hale which are design patents showing organizers appearing to have puralities of pockets and U.S. Pat. No. 5,427,230 to Mattox, which is a jewelry holder and organizer attaching the device to the hanger by velcro hanger tabs, the device having pockets and hooks to hold jewelry including bracelets and necklaces for display. It does not appear that this device is recommended for travel, but display so that the owner can readily see what jewelry is available through clear pocket covers. For transport, the device is rolled or folded into a compact bundle for travel.

II. SUMMARY OF THE INVENTION

During travel, most often additional luggage or carrying cases are required to contain the additional accessories for clothing items placed and stored in garment bags or other luggage. This additional luggage or carrying cases can cause one to exceed the limit on carry-on or check in luggage. The additional luggage may also pose additional risk during baggage handling for intrusion into one's bags or theft of items contained in the bag which is more common that most people believe. In order to alleviate this problem, the current hanger accessory sleeve provides for a concealed accessory storage device hidden beneath clothing placed upon a clothes hanger.

The primary objective of the sleeve is to provide a concealed accessory storage device which is not readily viewed by persons handling ones baggage, either at transportation sites or at hotels and lodging locations.

A second objective of the sleeve is to reduce the amount of luggage required to transport items and protect those items beneath the clothing hung on the clothes hanger, protecting jewelry and other delicate items under the clothing securely contained with the sleeve.

A third objective of the sleeve is to provide for a multiplicity of storage pockets for small items of jewelry, undergarment, pins and insignias for uniforms or other clothing within at least one locked compartment, with other compartments and slots adapted to contain ties, scarfs, long slender items, socks, belts, braids, socks, hosiery and other clothing related travel accessories.

A fourth objective of the sleeve is to provide the sleeve to conform to a clothing hanger with an upper slot for the hook to be inserted through with the sleeve contouring to the slope of the hanger so that clothing items may be hung over the sleeve without disclosing the sleeve and without causing distortion to the clothing hung on the clothing hanger over the sleeve.

III. DESCRIPTION OF THE DRAWINGS

The following drawings are submitted with this utility patent application.

IV. DESCRIPTION OF THE PREFERRED EMBODIMENT

Figure 1:
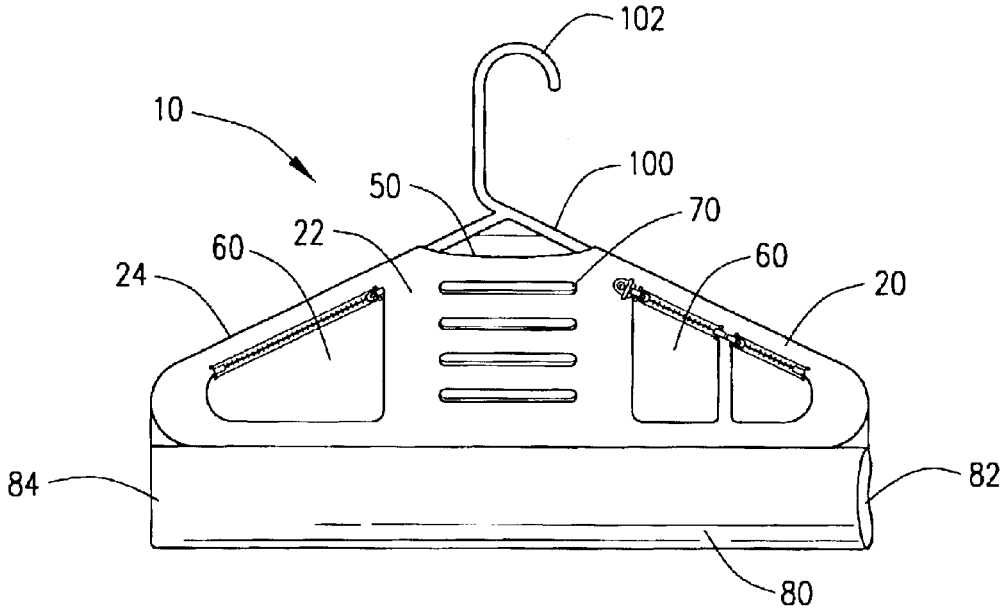
FIG. 1 is a front view or rear view of the sleeve on a clothes hanger.
Figure 2:
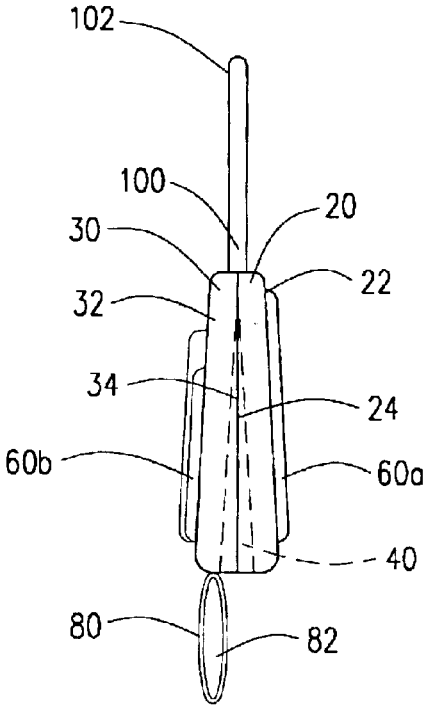
FIG. 2 is a side view of the sleeve on a garment hanger.
Figure 3:
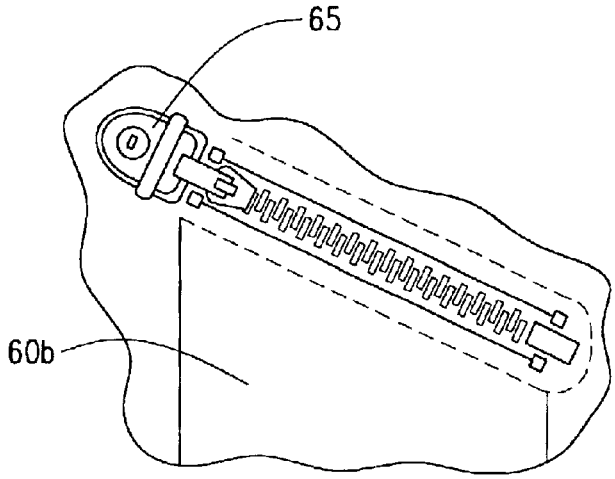
FIG. 3 is a view of a locking means on the zipper of a compartment on the sleeve.
Figure 4:
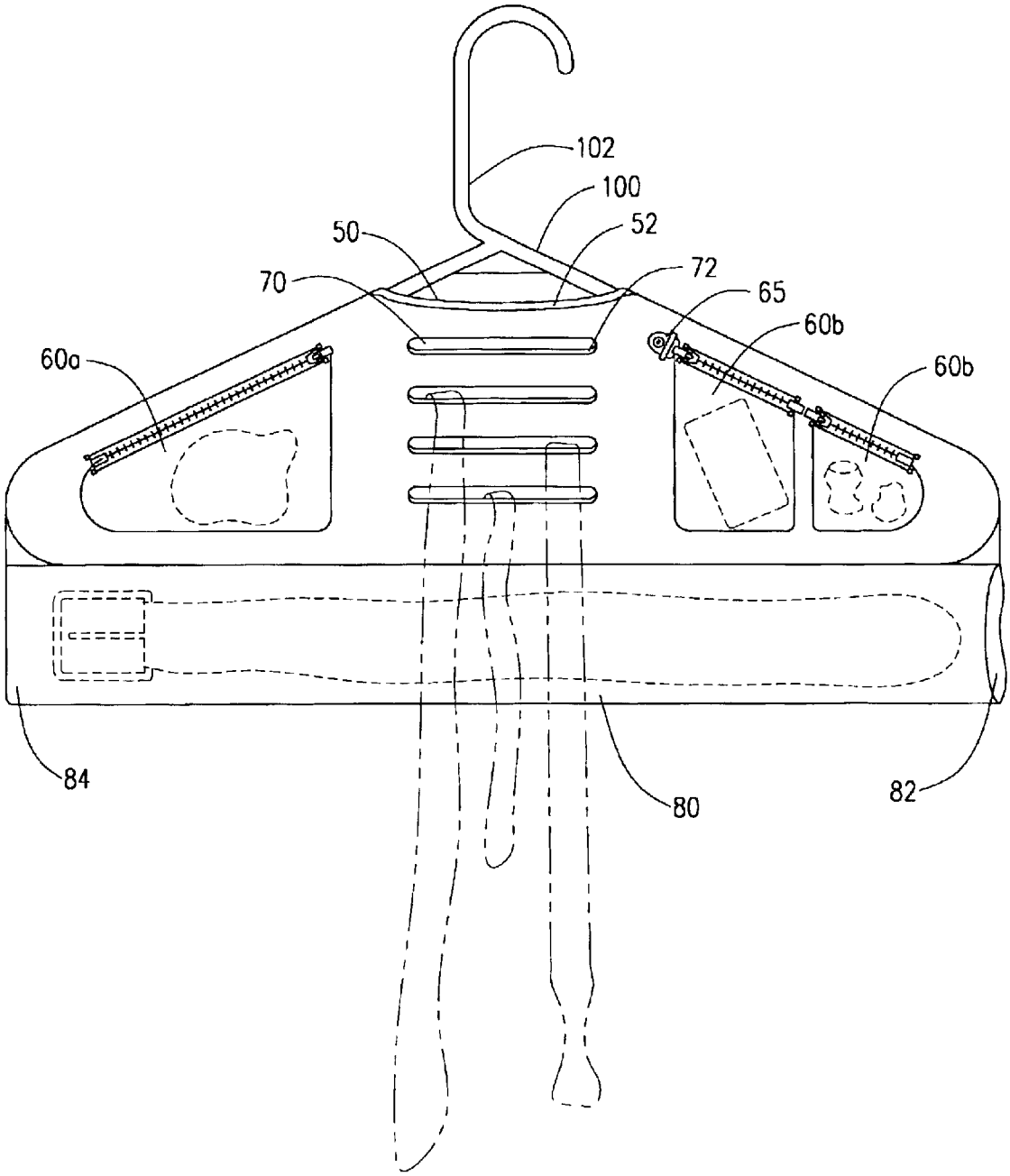
FIG. 4 is a front view of the sleeve containing the outlines of several items.

A secured and concealed hanger accessory sleeve 10, shown in FIGS. 1-4 of the drawings, adapted to be placed over a clothes hanger 100 having a central hook 102 to contain and store uniform and clothing accessory items, jewelry, insignias for uniforms, medals, pins, belts, scarfs, ribbons and braid, comprises a front panel 20 having an outer surface 22 and an upper angular margin 24, a rear panel 30 having an outer surface 32 and an upper angular margin 34, the front panel 20 and rear panel 30 attached together along their respective upper angular margins 24, 34 with a central slot 50 through which the central hook 102 may be inserted. On the outer surfaces 22, 24 of the front panel 20 and rear panel 30, as shown in FIGS. 1, 2 and 4 of the drawings, are a plurality of closeable pockets 60 and a plurality of horizontal slots 70, with at least one of the closeable pockets 60 having a locking means 65 to deter access to said pocket 60. In addition, at least one long horizontal compartment 80 is placed below the front panel 20 and rear panel 30. The front panel 20 and rear panel 30 define an inner cavity 40 which is adapted to accept the clothes hanger 100 with the upper angular margins 24, 34 attached together resting upon the clothes hanger 100 with the central hook 102 extending above the sleeve 10, as shown in FIGS. 1, 2 and 4 of the drawings.

Most preferably, the front panel 20 and rear panel 30 have at least one large triangular pocket 60*a* to accept large scale items, including handkerchiefs, socks, hosiery and gloves. At least two smaller pockets 60*b* are also included on each front panel 20 and rear panel 30 to contain smaller to scale items and items of value, including jewelry watches, insignias, pins and ear rings, with the locking means 65, shown in FIG. 3, being applied to at least one of these smaller pockets 60*b*. The horizontal slots 70, shown in FIG. 1, may include a lower stiffening means 72 to provide for rigid support of the horizontal slots 70 and those items placed within the horizontal slots 70.

The long horizontal compartment 80 preferably has a first end 82 which is closed and a second end 84 which is open, with the long horizontal compartment 80 freely dangling below the clothes hanger 100 upon which the sleeve 10 is placed. A reenforced collar 52 may also be included within the central slot 50 to provide strength to the central slot 50 around the central hook 102 of the clothes hanger 100.

It is also contemplated that additional secondary pockets and compartments may be located within the inner cavity 40 providing additional storage and also additional non-visible storage. These additional pockets and compartments may also include a locking means to secure the items within said additional pockets and compartments.

In use, an intended objective of the sleeve 10 is to provide the sleeve 10 in a non-visible display on the clothes hanger 100 by placing articles of clothing on the clothes hanger 100 over the sleeve 10, covering as much of the sleeve 10 as possible. Therefore, most preferably the sleeve 10 applied to the clothes hanger 100 will not appear outside the collar of a shirt or blouse. In addition, while the device is disclosed being fitted upon a wire clothes hanger 100, the sleeve 10 may be provided in such size and shape to fit any clothing hanger regardless of shape, the shape intended to be that of a clothes hanger 100 without being fitted to any particular clothes hanger.

While the invention has been particularly shown and described with reference to a preferred embodiment thereof, it will be understood by those skilled in the art that changes in form and detail may be made therein without departing from the spirit and scope of the invention.

What is claimed is:

1. A secured and concealed hanger accessory sleeve adapted to be placed upon a clothes hanger having a central hook, containing and storing uniform and clothing accessory items, jewelry, insignias for uniforms, medals, pins, belts, scarfs, ribbons and braid, comprising:

a front panel having an outer surface and an upper angular margin;

a rear panel having an outer surface and an upper angular margin, the front panel and rear panel attached together along their respective upper angular margins forming an inner cavity between the front panel and rear panel within which a clothes hanger is inserted;

a central slot through which the central hook of the clothes hanger is inserted;

a plurality of closeable pockets and a plurality of horizontal slots on the outer surfaces of the front panel and rear panel, with at least one of the closeable pockets having a locking means; and at least one long horizontal compartment placed below the front panel and rear panel.

2. The hanger accessory sleeve, as disclosed in claim 1, wherein the plurality of closeable pockets on the front panel and rear panel further comprise;

at least one large triangular pocket to accept larger scale items;

at least two smaller pockets to contain smaller scale and items of value, with the locking means applied to at least one of these smaller pockets.

3. The hanger accessory sleeve, as disclosed in claim 1, the horizontal slots further comprising a lower stiffening means to provide for rigid support of the horizontal slots and those items placed within the horizontal slots.

4. The hanger accessory sleeve, as disclosed in claim 1, wherein the long horizontal compartment further comprises:

a first end which is closed;

and a second end which is open, with the horizontal compartment freely dangling below the clothes hanger upon which the sleeve is placed.

5. The hanger accessory sleeve, as disclosed in claim 1, wherein the central slot includes a reenforced collar providing strength to the central slot surrounding the central hook of the clothes hanger.

6. A secured and concealed hanger accessory sleeve adapted to be placed upon a clothes hanger having a central hook, containing and storing uniform and clothing accessory items, jewelry, insignias for uniforms, medals, pins; belts, scarfs, ribbons and braid, comprising:

a front panel having an outer surface and an upper angular margin;

a rear panel having an outer surface and an upper angular margin, the front panel and rear panel attached together along their respective upper angular margins forming an inner cavity between the front panel and rear panel within which a clothes hanger is inserted;

a central slot having a reenforced collar through which the central hook of the clothes hanger is inserted;

a plurality of closeable pockets and a plurality of horizontal slots on the outer surfaces of the front panel and rear panel, with at least one of the closeable pockets having a locking means and the each of the horizontal slots including lower stiffening means; and at least one long horizontal compartment having a first end which is closed, and a second end which is open, the horizontal compartment freely dangling below the clothes hanger upon which the sleeve is placed.

* * * * *